US009838820B2

(12) United States Patent
Someda et al.

(10) Patent No.: US 9,838,820 B2
(45) Date of Patent: Dec. 5, 2017

(54) ACOUSTIC CONTROL APPARATUS

(71) Applicant: Kabushiki Kaisha Toshiba, Tokyo (JP)

(72) Inventors: Keiichiro Someda, Kanagawa (JP); Akihiko Enamito, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/407,575

(22) Filed: Jan. 17, 2017

(65) Prior Publication Data

US 2017/0127208 A1 May 4, 2017

Related U.S. Application Data

(63) Continuation of application No. 14/725,042, filed on May 29, 2015, now abandoned.

(30) Foreign Application Priority Data

May 30, 2014 (JP) ..... 2014-113032

(51) Int. Cl.
*H04R 5/00* (2006.01)
*H04S 5/00* (2006.01)
*H04S 7/00* (2006.01)

(52) U.S. Cl.
CPC ..... *H04S 5/005* (2013.01); *H04S 7/303* (2013.01); *H04S 7/307* (2013.01); *H04S 2420/01* (2013.01)

(58) Field of Classification Search
CPC ..... H04S 2420/01; H04S 1/002; H04S 1/005; H04S 5/00
See application file for complete search history.

(56) References Cited

U.S. PATENT DOCUMENTS

| | | | | |
|---|---|---|---|---|
| 6,574,339 | B1 | 6/2003 | Kim et al. | |
| 2003/0065513 | A1 | 4/2003 | Kaminuma | |
| 2007/0098183 | A1 | 5/2007 | Enamito et al. | |
| 2012/0201405 | A1* | 8/2012 | Slamka | H04S 7/306 381/307 |
| 2012/0308056 | A1 | 12/2012 | Nakayama | |

(Continued)

FOREIGN PATENT DOCUMENTS

| | | |
|---|---|---|
| JP | 3-270400 | 12/1991 |
| JP | 2001-95082 | 4/2001 |

(Continued)

*Primary Examiner* — Regina N Holder
(74) *Attorney, Agent, or Firm* — Finnegan, Henderson, Farabow, Garrett & Dunner, L.L.P.

(57) ABSTRACT

The present disclosure relates to an acoustic control apparatus applied to a loudspeaker system including first to Mth loudspeakers. In one implementation, the apparatus includes first to Mth control filters. The first to Mth control filters convolve a first input sound signal with first to Mth control filter coefficients to generate first to Mth sound signals. The first to Mth loudspeakers produce sounds based on the first to Mth sound signals. The second to Mth control filter coefficients are calculated based on the first control filter coefficient and at least one first acoustic transfer function set from the first to Mth loudspeakers to at least one first one-ear position, such that a spatial average of at least one sound pressure of the sounds at the at least one first one-ear position comes close to 0.

17 Claims, 6 Drawing Sheets

(56) References Cited

U.S. PATENT DOCUMENTS

| | | | |
|---|---|---|---|
| 2012/0328108 | A1 | 12/2012 | Enamito et al. |
| 2014/0169595 | A1 | 6/2014 | Enamito et al. |
| 2015/0092944 | A1 | 4/2015 | Someda et al. |

FOREIGN PATENT DOCUMENTS

| | | |
|---|---|---|
| JP | 2001-292500 | 10/2001 |
| JP | 2003-174699 | 6/2003 |
| JP | 2007-121439 | 5/2007 |
| JP | 2008-252625 | 10/2008 |
| JP | 2009-10866 | 1/2009 |
| JP | 2009-51333 | 3/2009 |
| JP | 4364326 | 8/2009 |
| JP | 2010-199802 | 9/2010 |
| JP | 4605149 | 10/2010 |
| JP | 2012-70135 | 4/2012 |
| JP | 2013-13042 | 1/2013 |
| JP | 2013-31145 | 2/2013 |
| JP | 2014-93698 | 5/2014 |
| JP | 2015-70578 | 4/2015 |

* cited by examiner

ACOUSTIC CONTROL APPARATUS

CROSS-REFERENCE TO RELATED APPLICATIONS

This application is a continuation of and claims the benefit of priority from U.S. application Ser. No. 14/725,042, filed on May 29, 2015, which claims priority to Japanese Patent Application No. 2014-113032, filed on May 30, 2014. The contents of these applications are each incorporated herein by reference in their entirety.

FIELD

Embodiments described herein relate generally to a loudspeaker system including an acoustic control apparatus.

BACKGROUND

There is known a technique of simulating a stereophonic effect by front loudspeakers. The stereophonic effect is an effect whereby a listener is tricked into thinking a sound is coming from a virtual sound source. However, it is difficult to successfully implement an acoustic effect such as a stereophonic effect in loudspeaker reproduction.

DETAILED DESCRIPTION

Figure 1:
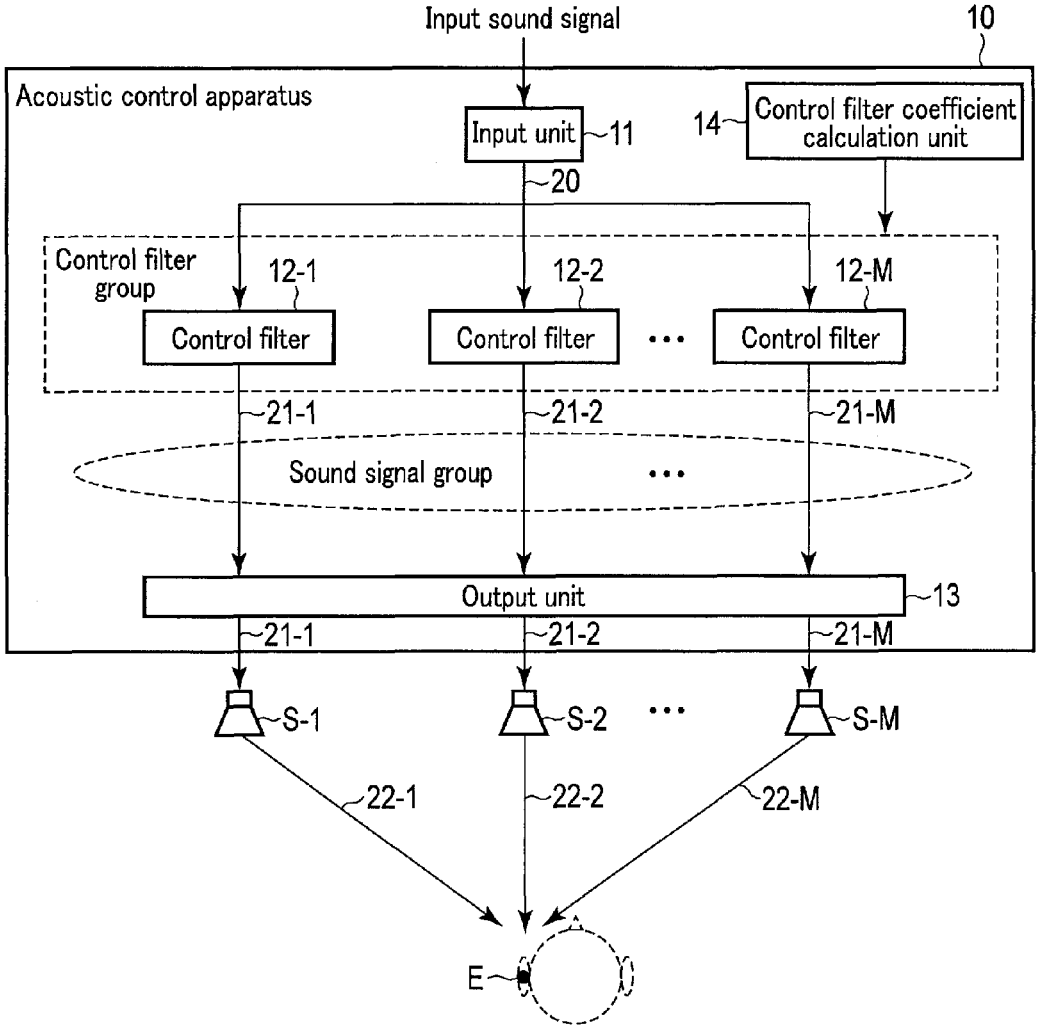
FIG. 1 is a block diagram showing an acoustic control apparatus according to the first embodiment.

According to an embodiment, an acoustic control apparatus applied to a loudspeaker system including first to Mth loudspeakers (M is an integer of not less than 2) includes first to Mth control filters, (M+1)th to (2×M)th control filters, and first to Mth adders. The first to Mth control filters are configured to convolve a first input sound signal with first to Mth control filter coefficients to generate first to Mth sound signals. The (M+1)th to (2×M)th control filters are configured to convolve a second input sound signal with (M+1)th to (2×M)th control filter coefficients to generate (M+1)th to (2×M)th sound signals. The first to Mth adders are configured to add the (M+1)th to (2×M)th sound signals to the first to Mth sound signals to generate first to Mth combined sound signals. The first to Mth loudspeakers produce first to Mth sounds in accordance with the first to Mth combined sound signals. The second to Mth control filter coefficients are calculated based on the first control filter coefficient, and at least one first acoustic transfer function set from the first to Mth loudspeakers to at least one first one-ear position, so that a spatial average of at least one sound pressure of the first to Mth sounds at the at least one first one-ear position comes close to 0. The (M+2)th to (2×M)th control filter coefficients are calculated based on the (M+1)th control filter coefficient, and at least one second acoustic transfer function set from the first to Mth loudspeakers to at least one second one-ear position, so that a spatial average of at least one sound pressure of the first to Mth sounds at the at least one second one-ear position comes close to 0.

Embodiments will now be described with reference to the accompanying drawings. In the following embodiments, the like reference numerals denote the like elements, and a repetitive description will be omitted.

(First Embodiment)

The first embodiment is directed to a loudspeaker system that transfers a sound signal of one channel to one ear of a listener present at a listening position. In other words, the loudspeaker system according to this embodiment minimizes a sound transferred to the other ear of the listener so as to be almost 0. The listening position is set at at least one position in front of a plurality of loudspeakers of the loudspeaker system.

FIG. 1 schematically shows the loudspeaker system according to the first embodiment. As shown in FIG. 1, this loudspeaker system includes an acoustic control apparatus 10, and M loudspeakers S-1, S-2, . . . , S-M, in which M represents the number of loudspeakers S and is an integer of 2 or more. The acoustic control apparatus 10 includes an input unit 11, M control filters 12-1, 12-2, . . . , 12-M, and an output unit 13.

The input unit 11 inputs an input sound signal 20 to the control filters 12-1, 12-2, . . . , 12-M. The input sound signal 20 is a sound signal of one channel, for example, one channel of binaural sound signals, one channel of stereophonic signals, or a monaural sound signal.

The control filters 12-1, 12-2, . . . , 12-M includes control filter coefficients $W_1$, $W_2$, . . . , $W_M$, and convolve the input sound signal 20 with the control filter coefficients $W_1$, $W_2$, . . . , $W_M$ to generate filtered sound signals 21-1, 21-2, . . . , 21-M. For example, the control filter 12-*j* convolves the input sound signal 20 with the control filter coefficient $W_j$ to generate the filtered sound signal 21-*j*, in which j is an integer of 1 to M. The filtered sound signals 21-1, 21-2, . . . , 21-M are supplied to the loudspeakers S-1, S-2, . . . , S-M via the output unit 13.

The loudspeakers S-1, S-2, . . . , S-M produce sounds 22-1, 22-2, . . . , 22-M in accordance with the filtered sound signals 21-1, 21-2, . . . , 21-M. For example, the loudspeaker S-j produces the sound 22-*j* in accordance with the filtered sound signal 21-*j*.

The acoustic control apparatus 10 performs acoustic control by using the control filter group so that the spatial average of at least one sound pressure at at least one one-ear position E comes close to 0. The example of FIG. 1 shows one one-ear position E. The one-ear position is a position that is set for each listening position so that a transferred sound comes close to 0. This position corresponds to the position of one ear (left ear in the example of FIG. 1) of a listener present at a listening position. The number of one-ear positions E equals the number of listening positions. The sound pressure is the sound pressure of sounds arriving at respective one-ear positions from all the loudspeakers S-1, S-2, . . . , S-M. In this embodiment, the sound pressure is made to come as close to 0 as possible, i.e., is minimized.

Figure 2:
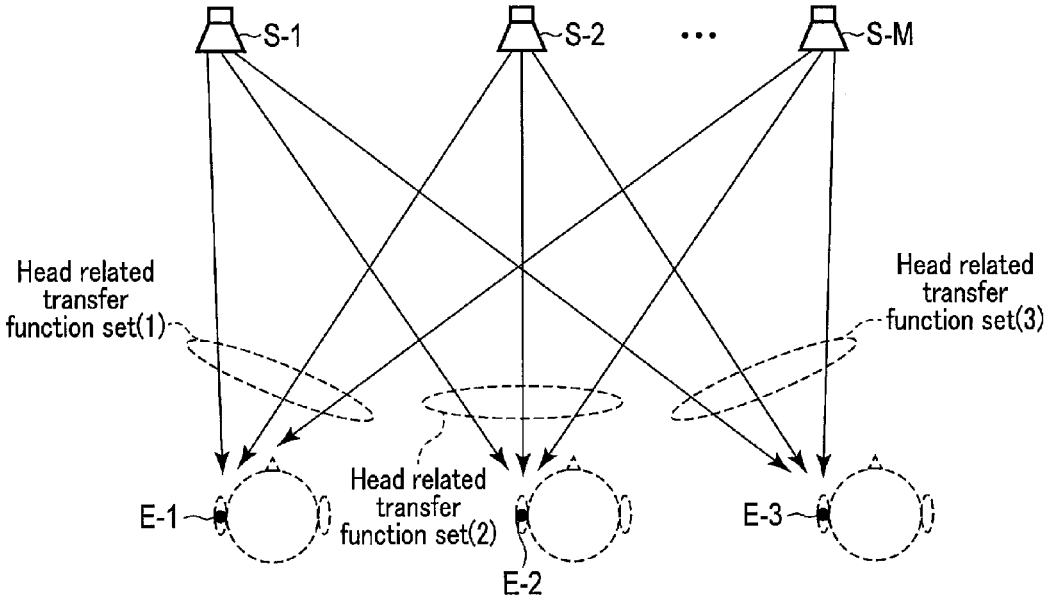
FIG. 2 is a view showing a setting example of a one-ear position.

FIG. 2 shows an example in which three one-ear positions, E-1, E-2, and E-3 are set. In a local region including the one-ear positions E-1, E-2, and E-3, the sound is reduced to 0 or greatly reduced. In practice, the one-ear positions E-1, E-2, and E-3 are not spaced apart from each other, unlike in FIG. 2, and are arranged and set at an interval of 2 to 10 cm appropriately. Note that the control target is the left ear of a listener in the example of FIG. 2, but may be the right ear.

There is one head-related transfer function set for each one-ear position E. The head-related transfer function set is a set of M head-related transfer functions from the M loudspeakers S-1, S-2, . . . , S-M to the one-ear position E. More specifically, in FIG. 2, a head-related transfer function set (1) corresponding to the one-ear position E-1 is a set of M head-related transfer functions from the respective loudspeakers S-1, S-2, . . . , S-M to the one-ear position E-1. A head-related transfer function set (2) corresponding to the one-ear position E-2 is a set of M head-related transfer functions from the respective loudspeakers S-1, S-2, . . . , S-M to the one-ear position E-2. A head-related transfer function set (3) corresponding to the one-ear position E-3 is a set of M head-related transfer functions from the respective loudspeakers S-1, S-2, . . . , S-M to the one-ear position E-3. The head-related transfer function is an acoustic transfer function from a loudspeaker to one ear when the head of a listener is present at the listening position. Note that an acoustic transfer function determined in accordance with only a distance from a loudspeaker to a one-ear position may be used instead of the head-related transfer function.

The larger the number of loudspeakers S used is, the closer to 0 sounds transferred to one ear of a listener can be. However, if the number of one-ear positions E becomes large with respect to the number of loudspeakers S, transferred sounds do not satisfactorily come close to 0, that is, a control error increases. Although the number of loudspeakers S and the number of one-ear positions E do not have upper limits, it is appropriate if, for example, the number M of loudspeakers is about two to six and the number of one-ear positions is about one to five.

Next, a control filter coefficient calculation method will be explained. Here, i represents the index of one-ear position (i=1 to N), and j represents the index of loudspeaker (j=1 to M). N represents the number of listening positions and is an integer of 1 or more. $P_i$ represents a sound pressure at the ith one-ear position E-i, $C_{ij}$ represents a head-related transfer function from the jth loudspeaker S-j to the ith one-ear position E-i, $q_j$ represents an output from the jth loudspeaker S-j, $W_j$ represents the control filter coefficient of the jth control filter 12-*j*, and s represents an input sound signal. Thus, the following equations (1) and (2) are established:

$$q_j = W_j \cdot s \tag{1}$$

$$P_i = \sum_{j=1}^{M} C_{ij} \cdot q_j \tag{2}$$

A spatial average Q of a sound pressure is defined by, for example:

$$Q = \sum_{i=1}^{N} P_i \cdot \overline{P_i} \tag{3}$$

In this embodiment, the spatial average Q of the sound pressure is made to come as close to 0 as possible. That is, the spatial average Q of the sound pressure is minimized. A conditional expression to achieve this is given by:

$$\frac{\partial Q}{\partial W_j} = 0 \tag{4}$$

$W_j$ that satisfies equation (4) can be calculated according to the following equations (5) to (8). Note that one of the control filter coefficients $W_1$ to $W_M$ can be arbitrarily determined. This embodiment assumes that the control filter coefficient $W_1$ of the control filter 12-1 is determined in advance. For example, when $W_1$=1, the control filter 12-1 has a through characteristic. That is, the control filter 12-1 outputs an input sound signal without processing it.

$$W_m = -\sum_{j=1}^{m-1} \frac{B_j^{(m)}}{B_m^{(m)}} W_j \quad (2 \le m \le M) \tag{5}$$

$$B_j^{(m)} = \sum_{i=1}^{N} A_{ij}^{(m)} \overline{A_{im}^{(m)}} \quad (1 \le j \le m) \tag{6}$$

$$A_{ij}^{(m-1)} = A_{ij}^{(m)} - A_{im}^{(m)} \frac{B_j^{(m)}}{B_m^{(m)}} \quad (1 \le i \le N,\ 1 \le j \le m-1) \tag{7}$$

$$A_{ij}^{(M)} = C_{ij} \quad (1 \le i \le N,\ 1 \le j \le M) \tag{8}$$

Figure 3:
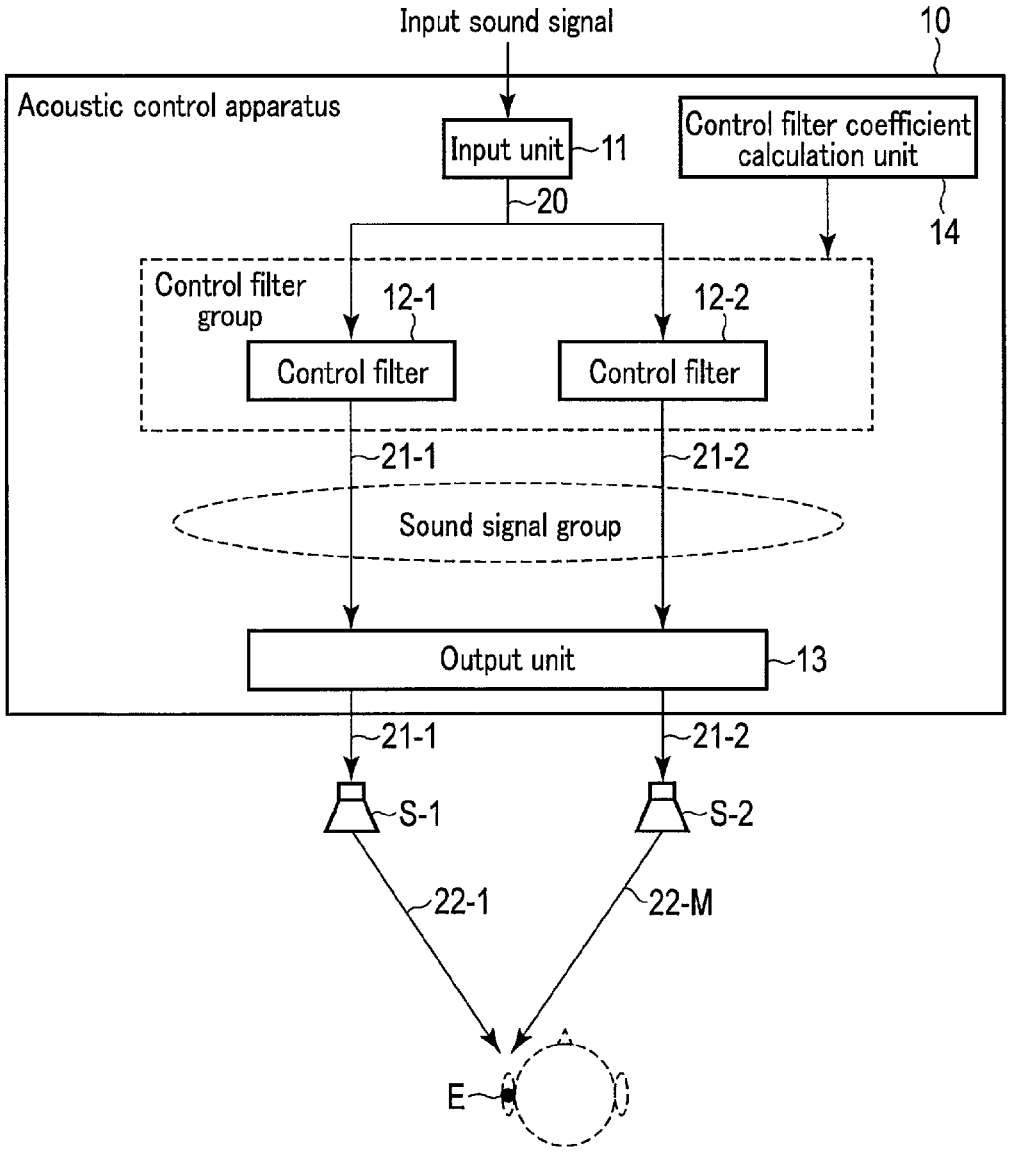
FIG. 3 is a block diagram showing an acoustic control apparatus according to the first embodiment when the acoustic control apparatus is applied to a loudspeaker system including two loudspeakers.

It will be confirmed by mathematical expressions that a sound pressure at a one-ear position comes close to 0 by using the control filter coefficients $W_1$ to $W_M$ calculated according to equations (5) to (8). To simplify the calculation, for example, a case in which the number of loudspeakers S is two (M=2) and the number of listening positions is one (N=1) will be examined. FIG. 3 shows a loudspeaker system according to the embodiment in this case. Calculation of the control filter coefficient $W_j$ using equations (5) to (8) is given by:

$$W_2 = -\frac{C_{11}}{C_{12}} W_1 \tag{9}$$

When M=2 and N=1, equation (2) is rewritten into:

$$P_1 = C_{11} \cdot W_1 \cdot s + C_{12} \cdot W_2 \cdot s \tag{10}$$

Apparently, a sound pressure $P_1$ certainly becomes 0 by substituting equation (9) into equation (10).

In an example, the control filter coefficients $W_1$, $W_2$, . . . , $W_M$ can be determined based on head-related transfer functions measured in advance. In this case, the control filters 12-1, 12-2, . . . , 12-M that hold the determined control filter coefficients $W_1$, $W_2$, . . . , $W_M$ are constructed in advance. In another example, the acoustic control apparatus 10 can further include a control filter coefficient calculation unit 14, as shown in FIG. 1. The control filter coefficient calculation unit 14 decides the control filter coefficients $W_1$, $W_2$, . . . , $W_M$ according to equations (5) to (8). More specifically, the control filter coefficient calculation unit 14 calculates at least one head-related transfer function set from the loudspeakers S-1, S-2, . . . , S-M to at least one one-ear position E based on the positions of the loudspeakers S-1, S-2, . . . , S-M and at least one listening position. Subsequently, the control filter coefficient calculation unit 14 calculates the control filter coefficients $W_2$ to $W_M$ based on at least one calculated head-related transfer function set and the control filter coefficient $W_1$ so that the spatial average of the sound pressure at at least one one-ear position E comes close to 0. The positions of the loudspeakers S-1, S-2, . . . , S-M, and listening positions are set by a listener via, for example, an input device (not shown).

As described above, the loudspeaker system according to the first embodiment performs acoustic control on an input sound signal by using the control filter group so that the spatial average of a sound pressure at at least one one-ear position comes close to 0. The loudspeaker system outputs a plurality of obtained sound signals from a plurality of loudspeakers. While transferring a sound to one ear of a listener present at a listening position, a sound transferred to the other ear can be reduced to 0 or greatly reduced.

(Second Embodiment)

The second embodiment is directed to a loudspeaker system that applies the acoustic control according to the first embodiment to sound signals of two channels, and corresponds to a combination of control filter groups according to the first embodiment for two systems. According to the second embodiment, a sound signal of one channel can be transferred to one ear of a listener present at a listening position, and a sound signal of the other channel can be transferred to the other ear of the listener.

Binaural sound signals are sound signals of two channels formed from a left-ear signal and a right-ear signal, and include stereophonic information. When the left-ear signal is directly transferred to the left ear of a listener and the right-ear signal is directly transferred to the right ear, a desired stereophonic effect is achieved. This can be implemented most easily by using headphones or earphones. When loudspeakers of two channels reproduce binaural sound signals without any processing, the left-ear signal is transferred to even the right ear of the listener and the right-ear signal is transferred to even the left ear. As a result, the desired stereophonic effect cannot be achieved.

When binaural sound signals are reproduced using the loudspeaker system according to this embodiment, the left-ear signal is transferred to the left ear of a listener and the right-ear signal is transferred to the right ear. That is, a desired stereophonic effect can be achieved, as in a case in which headphones or earphones are used.

Figure 4:
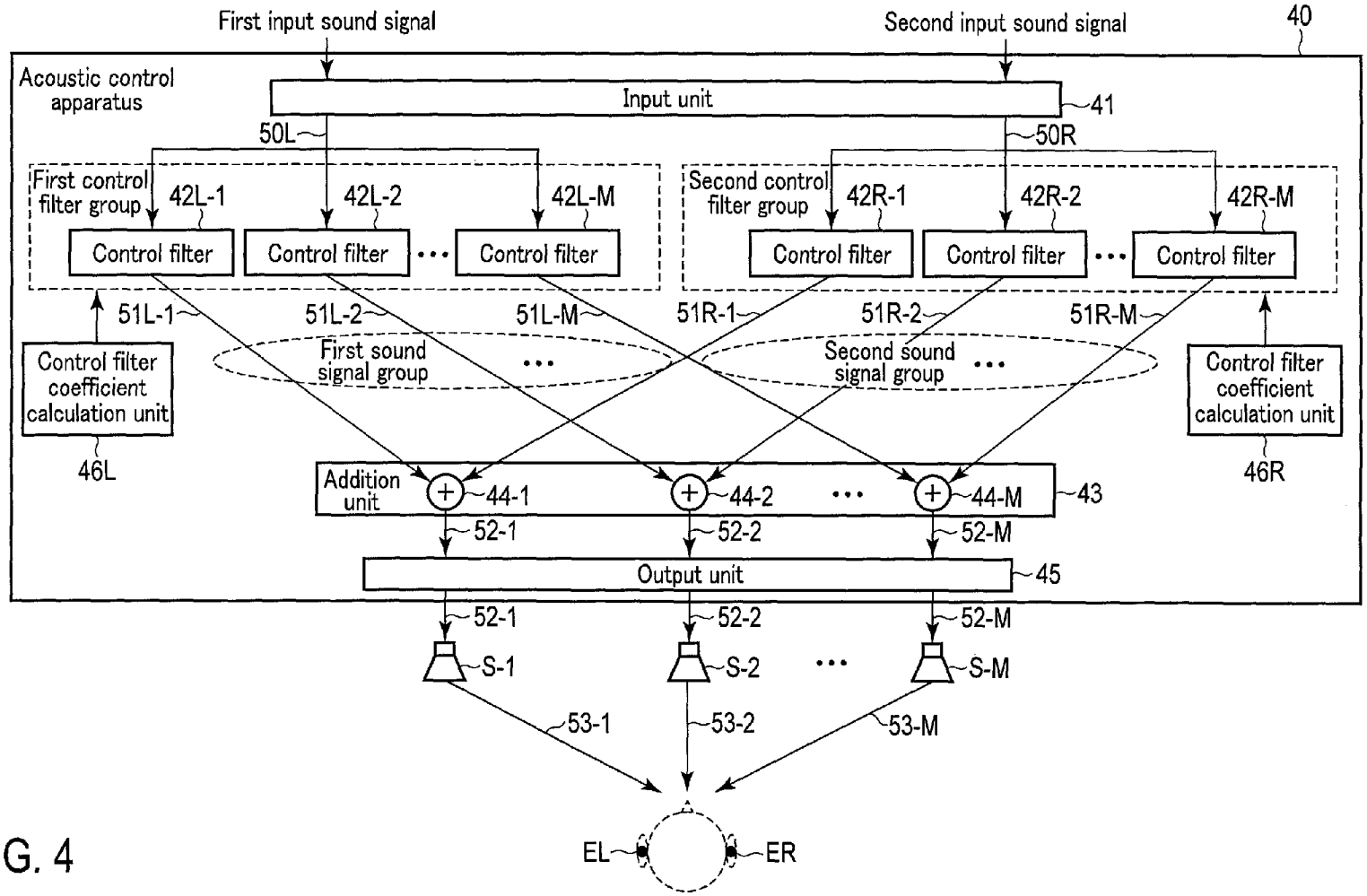
FIG. 4 is a block diagram showing an acoustic control apparatus according to the second embodiment.

FIG. 4 schematically shows the loudspeaker system according to the second embodiment. As shown in FIG. 4, this loudspeaker system includes an acoustic control apparatus 40, and M loudspeakers S-1, S-2, . . . , S-M, in which M represents the number of loudspeakers S and is an integer of 2 or more. The acoustic control apparatus 40 includes an input unit 41, a first control filter group including M control filters 42L-1, 42L-2, . . . , 42L-M, a second control filter group including M control filters 42R-1, 42R-2, . . . , 42R-M, an addition unit 43, and an output unit 45. The addition unit 43 includes M adders 44-1, 44-2, . . . , 44-M.

The input unit 41 inputs a first input sound signal 50L to the control filters 42L-1, 42L-2, . . . , 42L-M, and inputs a second input sound signal 50R to the control filters 42R-1, 42R-2, . . . , 42R-M. In this embodiment, the first input sound signal 50L is a left-ear signal of binaural sound signals, and the second input sound signal 50R is a right-ear signal of the binaural sound signals. Note that the first and second input sound signals 50L and 50R may be other arbitrary sound signals. For example, the first and second input sound signals 50L and 50R may be left and right channel signals of stereo sound signals.

The control filters 42L-1, 42L-2, . . . , 42L-M include control filter coefficients $W_{1L}$, $W_{2L}$, . . . , $W_{ML}$, and convolve the first input sound signal 50L with the control filter coefficients $W_{1L}$, $W_{2L}$, . . . , $W_{ML}$ to generate filtered sound signals 51L-1, 51L-2, . . . , 51L-M. For example, the control filter 42L-j convolves the first input sound signal 50L with the control filter coefficient $W_{jL}$ to generate the filtered sound signal 51L-j, in which j is an integer of 1 to M. The filtered sound signals 51L-1, 51L-2, . . . , 51L-M are supplied to the adders 44-1, 44-2, . . . , 44-M.

The control filters 42R-1, 42R-2, . . . , 42R-M include control filter coefficients $W_{1R}$, $W_{2R}$, . . . , $W_{MR}$, and convolve the second input sound signal 50R with the control filter coefficients $W_{1R}$, $W_{2R}$, . . . , $W_{MR}$ to generate filtered sound signals 51R-1, 51R-2, . . . , 51R-M. For example, the control filter 42R-j convolves the second input sound signal 50R with the control filter coefficient $W_{jR}$ to generate the filtered sound signal 51R-j. The filtered sound signals 51R-1, 51R-2, . . . , 51R-M are supplied to the adders 44-1, 44-2, . . . , 44-M.

The adders 44-1, 44-2, . . . , 44-M add the filtered sound signals 51R-1, 51R-2, . . . , 51R-M to the filtered sound signals 51L-1, 51L-2, . . . , 51L-M to generate combined sound signals 52-1, 52-2, . . . , 52-M. For example, the adder 44-*j* adds the filtered sound signal 51R-j to the filtered sound signal 51L-j to generate the combined sound signal 52-*j*.

The loudspeakers S-1, S-2, . . . , S-M produce sounds 53-1, 53-2, . . . , 53-M in accordance with the combined sound signals 52-1, 52-2, . . . , 52-M. For example, the loudspeaker S-j produces the sound 53-*j* in accordance with the combined sound signal 52-*j*.

Although the control filter groups are independent between the two signal processing systems, the loudspeakers S-1, S-2, . . . , S-M are shared between the two systems. In this manner, the loudspeakers S-1, S-2, . . . , S-M can be shared between the two signal processing systems because the principle of superposition is based on a physical phenomenon in which sound waves propagate from the loudspeakers S-1, S-2, . . . , S-M to a listener.

In this embodiment, a pair of a first one-ear position ER and second one-ear position EL is set for at least one listening position. Each of the number of first one-ear positions ER and the number of second one-ear positions EL is equal to the number of listening positions. The first one-ear position ER corresponds to the position of the right ear of a listener who is present at a listening position, and the second one-ear position EL corresponds to the position of the left ear of the listener who is present at the listening position.

The first control filter group is used in control for transferring the first input sound signal to the left ear of a listener at at least one listening position. The control filter coefficients $W_{1L}$, $W_{2L}$, . . . , $W_{ML}$ of the control filters 42L-1, 42L-2, . . . , 42L-M are determined so that the spatial average of a sound pressure at at least one first one-ear position ER comes close to 0. More specifically, the control filter coefficients $W_{1L}$, $W_{2L}$, . . . , $W_{ML}$ are calculated by the same method (using equations (5) to (8)) as that described in the first embodiment. For example, the control filter coefficients $W_{2L}$, . . . , $W_{ML}$ are calculated based on at least one first head-related transfer function set from the loudspeakers S-1, S-2, . . . , S-M to at least one first one-ear position ER, and the control filter coefficient $W_{1L}$ so that the spatial average of a sound pressure at at least one first one-ear position ER comes close to 0.

The second control filter group including the control filters 42R-1, 42R-2, . . . , 42R-M is used in control for transferring the second input sound signal to the right ear of the listener at at least one listening position. The control filter coefficients $W_{1R}$, $W_{2R}$, . . . , $W_{MR}$ of the control filters 42R-1, 42R-2, . . . , 42R-M are determined so that the spatial average of a sound pressure at at least one second one-ear position EL comes close to 0. More specifically, the control filter coefficients $W_{1R}$, $W_{2R}$, . . . , $W_{MR}$ are calculated by the same method (using equations (5) to (8)) as that described in the first embodiment. For example, the control filter coefficients $W_{2R}$, . . . , $W_{MR}$ are calculated based on at least one second head-related transfer function set from the loudspeakers S-1, S-2, . . . , S-M to at least one second one-ear position EL, and the control filter coefficient $W_{1R}$ so that the spatial average of a sound pressure at at least one second one-ear position EL comes close to 0.

In an example, the control filter coefficients $W_{1L}$, $W_{2L}$, . . . , $W_{ML}$, $W_{1R}$, $W_{2R}$, . . . , $W_{MR}$ are determined based on measured head-related transfer functions and are set in the control filters 42L-1, 42L-2, . . . , 42L-M, 42R-1, 42R-2, . . . , 42R-M. In another example, the acoustic control apparatus 40 further includes control filter coefficient calculation units 46L and 46R. Each of the control filter coefficient calculation units 46L and 46R performs the same operation as that of the control filter coefficient calculation unit 14 shown in FIG. 1. More specifically, the control filter coefficient calculation unit 46L calculates at least one first head-related transfer function set based on the positions of the loudspeakers S-1, S-2, . . . , S-M and at least one listening position. Subsequently, the control filter coefficient calculation unit 46L calculates the control filter coefficients $W_{2L}$ to $W_{ML}$ based on at least one calculated head-related transfer function set and the control filter coefficient $W_{1L}$ so that the spatial average of a sound pressure at at least one first one-ear position ER comes close to 0. The control filter coefficient calculation unit 46R calculates at least one second head-related transfer function set based on the positions of the loudspeakers S-1, S-2, . . . , S-M and at least one listening position. Subsequently, the control filter coefficient calculation unit 46R calculates the control filter coefficients $W_{2R}$ to $W_{MR}$ based on at least one calculated head-related transfer function set and the control filter coefficient $W_{1R}$ so that the spatial average of a sound pressure at at least one second one-ear position EL comes close to 0.

Figure 5:
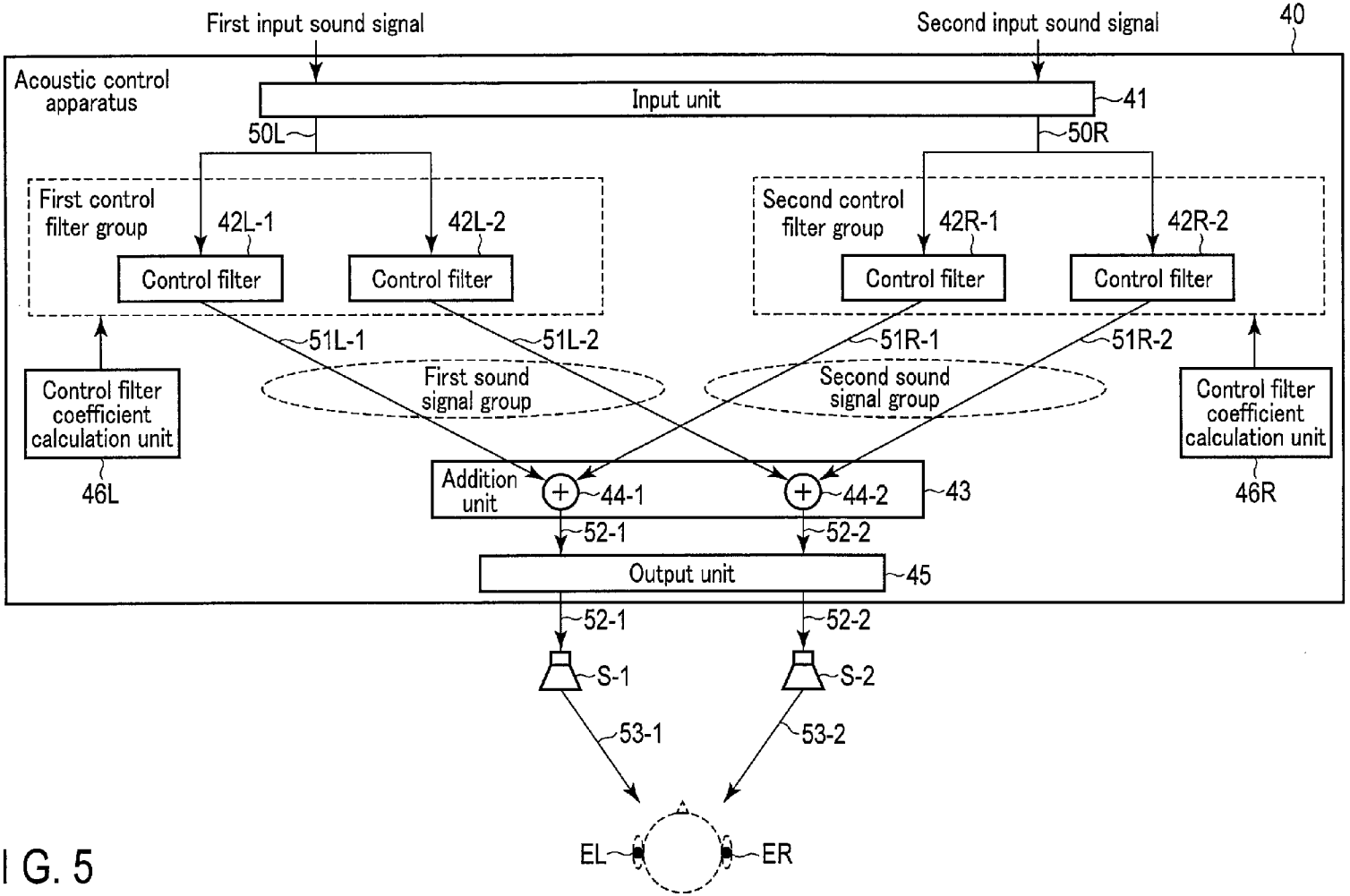
FIG. 5 is a block diagram showing an acoustic control apparatus according to the second embodiment when the acoustic control apparatus is applied to a loudspeaker system including two loudspeakers.

It will be confirmed by mathematical expressions that binaural sound signals are correctly transferred to a listener at at least one listening position in the loudspeaker system according to this embodiment. To simplify the calculation, for example, a case in which the number of loudspeakers S is two (M=2) and the number of listening positions is one (N=1) will be examined. FIG. 5 shows a loudspeaker system according to the embodiment in this case.

The acoustic control apparatus 40 shown in FIG. 5 includes the control filters 42L-1, 42L-2, 42R-1, and 42R-2, and the adders 44-1 and 44-2. The control filter 42L-1 convolves the first input sound signal 50L with the control filter coefficient $W_{1L}$ to generate the filtered sound signal 51L-1. The control filter 42L-2 convolves the first input sound signal 50L with the control filter coefficient $W_{2L}$ to generate the filtered sound signal 51L-2. The control filter 42R-1 convolves the second input sound signal 50R with the control filter coefficient $W_{1R}$ to generate the filtered sound signal 51R-1. The control filter 42R-2 convolves the second input sound signal 50R with the control filter coefficient $W_{2R}$ to generate the filtered sound signal 51R-2. The adder 44-1 adds the filtered sound signal 51R-1 to the filtered sound signal 51L-1 to generate the combined sound signal 52-1. The adder 44-2 adds the filtered sound signal 51R-2 to the filtered sound signal 51L-2 to generate the combined sound signal 52-2.

The control filter coefficient $W_{2L}$ is calculated based on the first head-related transfer function set and the control filter coefficient $W_{1L}$ so that the spatial average of a sound pressure at the first one-ear position ER comes close to 0. The first head-related transfer function set is a set of a head-related transfer function from the loudspeaker S-1 to the first one-ear position ER and a head-related transfer function from the loudspeaker S-2 to the first one-ear position ER. The control filter coefficient $W_{2R}$ is calculated based on the second head-related transfer function set and the control filter coefficient $W_{1R}$ so that the spatial average of a sound pressure at the second one-ear position EL comes close to 0. The second head-related transfer function set is a set of a head-related transfer function from the loudspeaker S-1 to the second one-ear position EL and a head-related transfer function from the loudspeaker S-2 to the second one-ear position EL.

Symbols are defined as follows:

j: index of the loudspeaker S (j=1, 2)

$s_L$: first input sound signal (left-ear signal of binaural sound signals)

$s_R$: second input sound signal (right-ear signal of binaural sound signals)

$W_{1L}$: control filter coefficient of the control filter 42L-1

$W_{2L}$: control filter coefficient of the control filter 42L-2

$W_{1R}$: control filter coefficient of the control filter 42R-1

$W_{2R}$: control filter coefficient of the control filter 42R-2

$q_j$: output from the loudspeaker S-j $C_{Rj}$: head-related transfer function from the loudspeaker S-j to the first one-ear position (right ear of a listener) ER $C_{Lj}$: head-related transfer function from the loudspeaker S-j to the second one-ear position (left ear of a listener) EL $P_R$: sound pressure at the first one-ear position (right ear of a listener) ER $P_L$: sound pressure at the second one-ear position (left ear of a listener) EL Since each of the first control filter group and the second control filter group is identical to the control filter group in the first embodiment, the control filters are calculated based on equations (11) and (12) by referring to equation (9):

$$W_{2L} = -\frac{C_{R1}}{C_{R2}} W_{1L} \tag{10}$$

$$W_{2R} = -\frac{C_{L1}}{C_{L2}} W_{1R} \tag{12}$$

Further, equations (13) to (16) are established:

$$q_1 = W_{1L} \cdot s_L + W_{1R} \cdot s_R \tag{13}$$

$$q_2 = W_{2L} \cdot s_L + W_{2R} \cdot s_R \tag{14}$$

$$P_R = C_{R1} \cdot q_1 + C_{R2} \cdot q_2 \tag{15}$$

$$P_L = C_{L1} \cdot q_1 + C_{L2} \cdot q_2 \tag{16}$$

From the above equations (11) to (16), the sound pressure $P_R$ at the first one-ear position ER and the sound pressure $P_L$ at the second one-ear position EL are derived as:

$$P_R = -(C_{L1}C_{R2} - C_{L2}C_{R1})\frac{W_{1R}}{C_{L2}} s_R \tag{17}$$

$$P_L = (C_{L1}C_{R2} - C_{L2}C_{R1})\frac{W_{1L}}{C_{R2}} s_L \tag{18}$$

According to equation (17), the sound pressure $P_R$ of the right ear of a listener includes only a component proportional to the right-ear signal $s_R$ of binaural sound signals, and does not include a component proportional to $s_L$. Similarly, according to equation (18), the sound pressure $P_L$ of the left ear of the listener includes only a component proportional to the left-ear signal $s_L$ of binaural sound signals, and does not include a component proportional to $s_R$. In other words, the left-ear signal of binaural sound signals reaches only the left ear of the listener, and the right-ear signal reaches only the right ear. Based on equations (17) and (18), the binaural sound signals are correctly transferred to the listener.

As described above, the loudspeaker system according to the second embodiment performs acoustic control on the first input sound signal by using the first control filter group so that the spatial average of a sound pressure at at least one first one-ear position comes close to 0. The loudspeaker system according to the second embodiment also performs acoustic control on the second input sound signal by using the second control filter group so that the spatial average of the sound pressure at at least one second one-ear position comes close to 0. Hence, the first input sound signal can be transferred to one ear of a listener present at a listening position, and the second input sound signal can be transferred to the other ear of the listener.

(Third Embodiment)

The third embodiment is directed to a loudspeaker system that performs acoustic control on a monaural sound signal, thereby implementing a stereophonic effect. A monaural sound signal is a sound signal of one channel including no stereophonic information. The third embodiment includes a part common to the second embodiment, and a description of this part will not be repeated.

Figure 6:
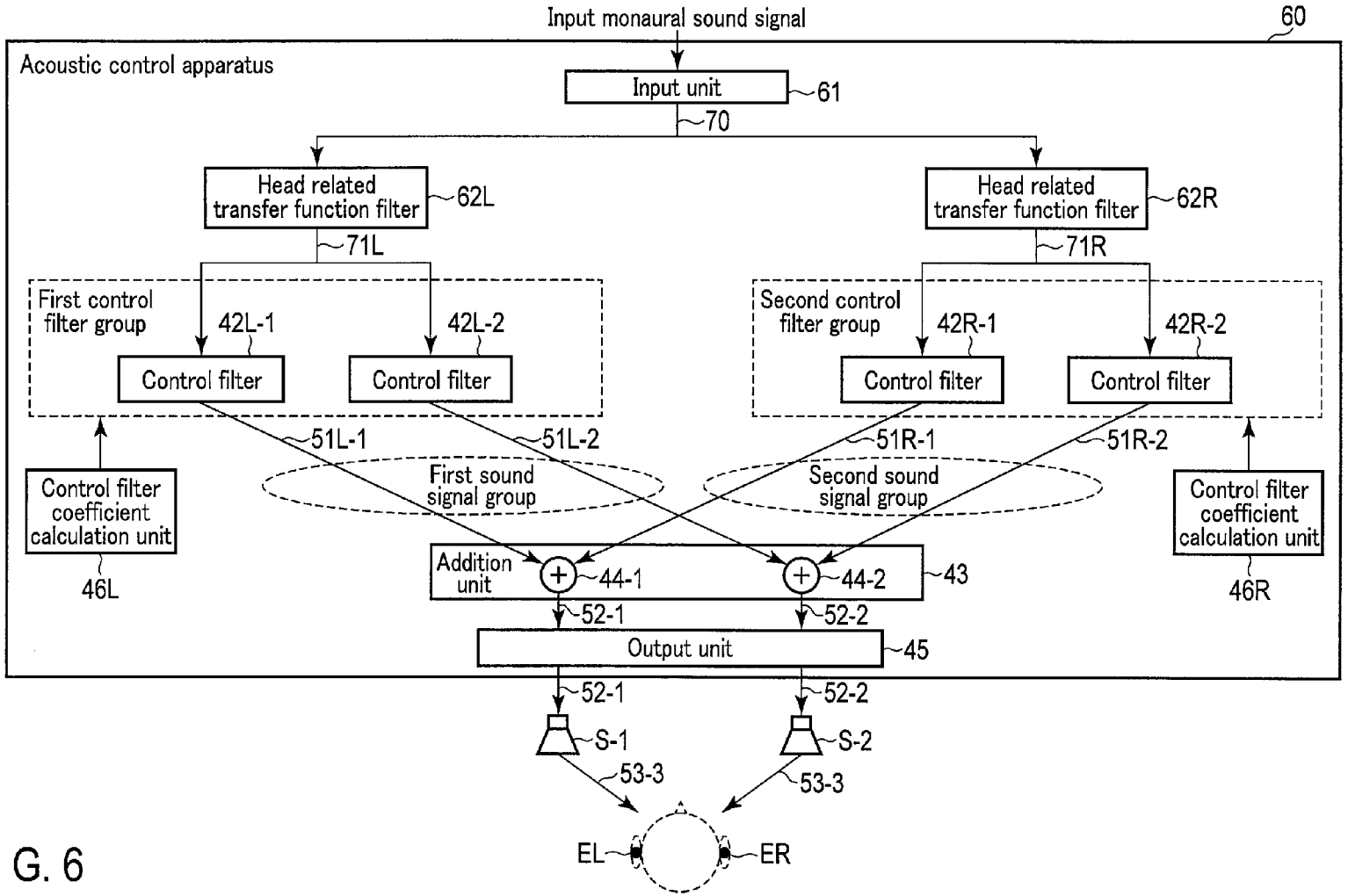
FIG. 6 is a block diagram showing an acoustic control apparatus according to the third embodiment.

FIG. 6 schematically shows the loudspeaker system according to the third embodiment. As shown in FIG. 6, this loudspeaker system includes an acoustic control apparatus 60, and a plurality of (two in this example) loudspeakers S-1 and S-2. The acoustic control apparatus 60 includes an input unit 61, head-related transfer function filters 62L and 62R, control filters 42L-1, 42L-2, 42R-1, and 42R-2, an addition unit 43, and an output unit 45. The control filters 42L-1, 42L-2, 42R-1, and 42R-2, the addition unit 43, and the output unit 45 has been described in the second embodiment, and a description thereof will not be repeated in the third embodiment.

The input unit 61 inputs an input monaural sound signal 70 to the head-related transfer function filters 62L and 62R. The head-related transfer function filter 62L convolves the input monaural sound signal 70 with the first head-related transfer function filter coefficient to generate a first input sound signal 71L. The first input sound signal 71L is supplied to the control filters 42L-1 and 42L-2. The first input sound signal 71L corresponds to the first input sound signal 50L in the second embodiment. The head-related transfer function filter 62R convolves the input monaural sound signal 70 with the second head-related transfer function filter coefficient to generate a second input sound signal 71R. The second input sound signal 71R is supplied to the control filters 42R-1 and 42R-2. The second input sound signal 71R corresponds to the second input sound signal 50R in the second embodiment.

The first head-related transfer function filter coefficient is a head-related transfer function from the position of a virtual sound source to the left ear of a listener. The second head-related transfer function filter coefficient is a head-related transfer function from the position of the virtual sound source to the right ear of the listener. The position of the virtual sound source is the position of a virtual sound source as believed by the listener. By convoluting the head-related transfer functions in a monaural sound signal, stereophony can be added to generate binaural sound signals. That is, the first input sound signal 71L and second input sound signal 71R shown in FIG. 6 are the left- and right-ear signals of binaural sound signals.

According to the third embodiment, stereophony can be added to a monaural sound signal including no stereophonic information. Hence, a listener present at at least one listening position can perceive stereophony, as in the second embodiment.

At least part of processing in each of the above-described embodiments can also be implemented by using a general-purpose computer as basic hardware. A program that implements the above-described processing may be provided by storing it in a computer-readable storage medium. The program is stored in a storage medium as a file of an installable format or a file of an executable format. Examples of the storage medium are a magnetic disk, an optical disk (for example, CD-ROM, CD-R, or DVD), a magneto-optical disk (for example, MO), and a semiconductor memory. The storage medium is arbitrary as long as it can store a program and is readable by a computer. The program that implements the above-described processing may be stored in a computer (server) connected to a network such as the Internet, and downloaded to a computer (client) via the network.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An acoustic control apparatus applied to a loudspeaker system including first to Mth loudspeakers (M is an integer of not less than2), the apparatus comprising:

first to Mth control filters which convolve a first input sound signal with first to Mth control filter coefficients to generate first to Mth sound signals, wherein-the second to Mth control filter coefficients are calculated based on the first control filter coefficient, and at least one first acoustic transfer function set from the first to Mth loudspeakers to at least one first position such that a spatial average of at least one sound pressure at the at least one first position when the first to Mth loudspeakers produce sounds in accordance with the first to Mth sound signals is reduced.

2. The apparatus according to claim 1, wherein the first to Mth control filter coefficients are determined in advance.

3. The apparatus according to claim 1, further comprising a first control filter coefficient calculation unit which calculates the second to Mth control filter coefficients.

4. The apparatus according to claim 1, wherein the at least one first acoustic transfer function set includes a plurality of head-related transfer functions from the first to Mth loudspeakers to the at least one first position.

5. The apparatus according to claim 1, wherein M is 2.

6. The apparatus according to claim 1, further comprising:

(M+1)th to (2×M)th control filters which convolve a second input sound signal with (M+1)th to (2×M)th control filter coefficients to generate (M+1)th to (2×M) th sound signals; and first to Mth adders which add the (M+1)th to (2×M)th sound signals to the first to Mth sound signals to generate first to Mth combined sound signals, the first to Mth combined sound signals being supplied to the first to Mth loudspeakers, wherein the (M+2)th to (2×M)th control filter coefficients are calculated based on the (M+1)th control filter coefficient and at least one second acoustic transfer function set from the first to Mth loudspeakers to at least one second position such that a spatial average of at least one sound pressure at the at least one second position when the first to Mth loudspeakers produce sounds in accordance with the (M+1)th to (2×M)th sound signals is reduced.

7. The apparatus according to claim 6, further comprising:

a first head-related transfer function filter which convolves a monaural sound signal with a first head-related transfer function filter coefficient to generate the first input sound signal; and a second head-related transfer function filter which convolves the monaural sound signal with a second head-related transfer function filter coefficient to generate the second input sound signal.

8. The apparatus according to claim 6, wherein the first to Mth control filter coefficients and the (M+1)th to (2×M)th control filter coefficients are determined in advance.

9. The apparatus according to claim 6, further comprising:

a first control filter coefficient calculation unit which calculates the second to Mth control filter coefficients; and a second control filter coefficient calculation unit which calculates the (M+2)th to (2×M)th control filter coefficients.

10. The apparatus according to claim 6, wherein:

the at least one first acoustic transfer function set includes a plurality of head-related transfer functions from the first to Mth loudspeakers to the at least one first position, and the at least one second acoustic transfer function set includes a plurality of head-related transfer functions from the first to Mth loudspeakers to the at least one second position.

11. The apparatus according to claim 6, wherein M is 2.

12. A loudspeaker system comprising:

first to Mth loudspeakers (M is an integer of not less than 2); and first to Mth control filters which convolve a first input sound signal with first to Mth control filter coefficients to generate first to Mth sound signals, wherein the second to Mth control filter coefficients are calculated based on the first control filter coefficient and at least one first acoustic transfer function set from the first to Mth loudspeakers to at least one first position such that a spatial average of at least one sound pressure at the at least one first position when the first to Mth loudspeakers produce sounds in accordance with the first to Mth sound signals is reduced.

13. The system according to claim 12, further comprising:

(M+1)th to (2×M)th control filters which convolve a second input sound signal with (M+1)th to (2×M)th control filter coefficients to generate (M+1)th to (2×M) th sound signals; and first to Mth adders which add the (M+1)th to (2×M)th sound signals to the first to Mth sound signals to generate first to Mth combined sound signals, wherein the first to Mth loudspeakers produce sounds in accordance with the first to Mth combined sound signals, and the (M+2)th to (2×M)th control filter coefficients are calculated based on the (M+1)th control filter coefficient and at least one second acoustic transfer function set from the first to Mth loudspeakers to at least one second position such that a spatial average of at least one sound pressure at the at least one second position when the first to Mth loudspeakers produce sounds in accordance with the (M+1)th to (2×M)th sound signals is reduced.

14. An acoustic control method for a loudspeaker system including first to Mth loudspeakers (M is an integer of not less than 2), the method comprising:

convolving a first input sound signal with first to Mth control filter coefficients to generate first to Mth sound signals, wherein the second to Mth control filter coefficients are calculated based on the first control filter coefficient and at least one first acoustic transfer function set from the first to Mth loudspeakers to at least one first position such that a spatial average of at least one sound pressure at the at least one first position when the first to Mth loudspeakers produce sounds in accordance with the first to Mth sound signals is reduced.

15. The method according to claim 14, further comprising:

convolving a second input sound signal with (M+1)th to (2×M)th control filter coefficients to generate (M+1)th to (2×M)th sound signals; and adding the (M+1)th to (2×M)th sound signals to the first to Mth sound signals to generate first to Mth combined sound signals, the first to Mth combined sound signals being supplied to the first to Mth loudspeakers, wherein the (M+2)th to (2×M)th control filter coefficients are calculated based on the (M+1)th control filter coefficient and at least one second acoustic transfer function set from the first to Mth loudspeakers to at least one second position such that a spatial average of at least one sound pressure at the at least one second position when the first to Mth loudspeakers produce sounds in accordance with the (M+1)th to (2×M)th sound signals is reduced.

16. A non-transitory computer readable medium including computer executable instructions, wherein the instructions, when executed by a processor, cause the processor to perform a method for a loudspeaker system including first to Mth loudspeakers (M is an integer of not less than 2), the method comprising:

convolving a first input sound signal with first to Mth control filter coefficients to generate first to Mth sound signals, wherein the second to Mth control filter coefficients are calculated based on the first control filter coefficient and at least one first acoustic transfer function set from first to Mth loudspeakers to at least one first position such that a spatial average of at least one sound pressure at the at least one first position when the first to Mth loudspeakers produce sounds in accordance with the first to Mth sound signals is reduced.

17. The medium according to claim 16, wherein the method further comprises:

convolving a second input sound signal with (M+1)th to (2×M)th control filter coefficients to generate (M+1)th to (2×M)th sound signals; and adding the (M+1)th to (2×M)th sound signals to the first to Mth sound signals to generate first to Mth combined sound signals, the first to Mth combined sound signals being supplied to the first to Mth loudspeakers, wherein the (M+2)th to (2×M)th control filter coefficients are calculated based on the (M+1)th control filter coefficient and at least one second acoustic transfer function set from the first to Mth loudspeakers to at least one second position such that a spatial average of at least one sound pressure at the at least one second position when the first to Mth loudspeakers produce sounds in accordance with the (M+1)th to (2×M)th sound signals is reduced.

* * * * *